US008820729B2

(12) United States Patent
Doi et al.

(10) Patent No.: US 8,820,729 B2
(45) Date of Patent: Sep. 2, 2014

(54) MAGNET HOLDING JIG

(75) Inventors: Yuhito Doi, Echizen (JP); Takayuki Hasegawa, Echizen (JP); Takaharu Yamaguchi, Echizen (JP); Takehisa Minowa, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 13/530,527

(22) Filed: Jun. 22, 2012

(65) Prior Publication Data

US 2012/0326371 A1 Dec. 27, 2012

(30) Foreign Application Priority Data

Jun. 27, 2011 (JP) ..... 2011-141504

(51) Int. Cl.

| | |
|---|---|
| ***B23Q 3/00*** | (2006.01) |
| ***B24B 55/02*** | (2006.01) |
| ***B26D 7/08*** | (2006.01) |
| *B23Q 3/15* | (2006.01) |

(52) U.S. Cl.
USPC ..... 269/296; 451/449; 83/169

(58) Field of Classification Search
USPC ..... 269/8; 451/449
See application file for complete search history.

(56) References Cited

U.S. PATENT DOCUMENTS

| | | | | |
|---|---|---|---|---|
| 2,511,962 | A * | 6/1950 | Barnes | 451/41 |
| 5,351,578 | A * | 10/1994 | Emter | 76/41 |
| 5,761,980 | A * | 6/1998 | Ima et al. | 83/500 |
| 6,463,920 | B1 * | 10/2002 | Kondo et al. | 125/15 |
| 6,577,804 | B2 * | 6/2003 | Murakami et al. | 385/147 |
| 6,595,094 | B1 * | 7/2003 | Kondo et al. | 83/471.2 |
| 6,889,586 | B2 * | 5/2005 | Kondo et al. | 83/169 |
| 7,040,969 | B1 * | 5/2006 | Chikuba et al. | 451/57 |
| 2003/0205119 | A1 * | 11/2003 | Kondo et al. | 83/13 |
| 2010/0112904 | A1 | 5/2010 | Sato et al. | |
| 2011/0162504 | A1 | 7/2011 | Doi et al. | |
| 2011/0165822 | A1 | 7/2011 | Doi et al. | |

FOREIGN PATENT DOCUMENTS

| | | | |
|---|---|---|---|
| JP | 05-80675 | U | 11/1993 |
| JP | 6-304833 | A | 11/1994 |
| JP | 11-207552 | A | 8/1999 |
| JP | 2001-212730 | A | 8/2001 |
| JP | 2006-68998 | A | 3/2006 |
| JP | 2007-044806 | A | 2/2007 |
| JP | 2008-044076 | A | 2/2008 |
| JP | 2010-110850 | A | 5/2010 |

OTHER PUBLICATIONS

Office Action dated Apr. 30, 2014, issued in Corresponding Japanese Patent Application No. 2011-141504 (4 pages).

* cited by examiner

*Primary Examiner* — Lee D Wilson
*Assistant Examiner* — Alvin Grant
(74) *Attorney, Agent, or Firm* — Westerman, Hattori, Daniels & Adrian, LLP

(57) ABSTRACT

When a rare earth magnet block is cut or ground by a cutting or grinding tool, a jig is used for holding the magnet block in place. The jig comprises a base, a pair of metal support members disposed on opposite sides of the base and provided with grooves, and rubber rods received in the support member grooves such that the rubber rod partially protrudes from the groove and abuts on the groove bottom. The magnet block is rested on the base and clamped between the rubber rods. The volume of the groove is larger than the volume of the rubber rod.

9 Claims, 8 Drawing Sheets

MAGNET HOLDING JIG

CROSS-REFERENCE TO RELATED APPLICATION

This non-provisional application claims priority under 35 U.S.C. §119(a) on Patent Application No. 2011-141504 filed in Japan on Jun. 27, 2011, the entire contents of which are hereby incorporated by reference.

TECHNICAL FIELD

This invention generally relates to a jig for fixedly holding a rare earth magnet block during cutting or grinding operation by a rotary abrasive tool.

BACKGROUND ART

Systems for manufacturing commercial products of rare earth magnet include a single part system wherein a part of substantially the same shape as the product is produced at the stage of pressing, and a multiple part system wherein once a large block is shaped, it is divided into a plurality of parts by machining. In the single part system, a pressed part, a sintered or heat treated part, and a finished part (or product) are substantially identical in shape and size. Insofar as normal sintering is performed, a sintered part of near net shape is obtained, and the load of the finishing step is relatively low. However, when it is desired to manufacture parts of small size or parts having a reduced thickness in magnetization direction, the sequence of pressing and sintering is difficult to form sintered parts of normal shape, leading to a lowering of manufacturing yield, and at worst, such parts cannot be formed.

In contrast, the multiple part system eliminates the above-mentioned problems and allows pressing and sintering or heat treating steps to be performed with high productivity and versatility. It now becomes the mainstream of rare earth magnet manufacture. In the multiple part system, a pressed block and a sintered or heat treated block are substantially identical in shape and size, but the subsequent finishing step requires cutting or grinding. It is the key for manufacture of finished parts how to cut, grind or otherwise machine the block in the most efficient and least wasteful manner.

For the machining of rare earth magnet blocks, outer-blade cutoff wheels (in the form of a diamond wheel having diamond abrasives bonded to an outer periphery of a disk) are generally used as well as grinding wheels.

When a rare earth magnet block is cutoff machined by such wheels, the magnet block is generally secured to a carbon-based support by bonding with wax or a similar adhesive which can be removed after cutting. The bonding with wax is achieved by heating the carbon-based support and the magnet block, applying molten wax between the support and the magnet block, and cooling for solidification. In this state, the magnet block is cut into pieces. After the cutting operation, heat is applied to melt the wax, allowing the magnet pieces to be removed from the support. Since wax is kept attached to the magnet pieces at this point, the wax must be removed using a solvent or the like.

The adhesive way of securing a magnet block with wax involves concomitant steps of heat bonding, heat stripping and cleaning in addition to the cutting step. This renders the process very cumbersome and adds to the cost of the cutting process. Insufficient securement may exacerbate the accuracy of cutting and allow for chipping during the cutting operation.

Patent Documents 1 and 2 disclose jigs for holding a magnet block or workpiece without a need for adhesion. These jigs are configured to clamp the workpiece utilizing the elasticity of rubber or resin. As alluded to previously, magnet machining starts with a magnet block as sintered. Since the dimensional accuracy of a sintered magnet block is affected by the powder density and pressure during pressing prior to sintering and the atmosphere and temperature during sintering, the block has noticeable dimensional variations. To tightly hold such a block without adhesion, the jigs utilizing deformation of elastic members as in Patent Documents 1 and 2 are effective. However, there still remain problems including allowance for movement during cutting operation owing to elasticity and degradation of elastic members. Then the problems of chipping and dimensional accuracy are not fully solved.

CITATION LIST

Patent Document 1: JP-A 2001-212730
Patent Document 2: JP-A 2006-068998

DISCLOSURE OF INVENTION

An object of the invention is to provide a jig for holding a rare earth magnet block in place when the magnet block is machined, which is effective for tightly holding the magnet block during and immediately after machining, thus producing machined parts with improved dimensional accuracy.

The invention pertains to a magnet holding jig for use with a magnet cutting or grinding tool. The magnet cutting tool comprises a plurality of annular cores mounted on a rotating shaft at axially spaced apart positions and each having an outer blade on an outer periphery thereof. The magnet grinding tool comprises a cylindrical core mounted on a rotating shaft and having an abrasive section on an outer periphery thereof. By rotating the tool together with the rotating shaft and moving the tool relative to a rare earth magnet block in a predetermined direction, the magnet block is cut or ground in the relative moving direction.

In one aspect, the invention provides a jig for fixedly holding the rare earth magnet block in place during the cutting or grinding operation, comprising a base on which the magnet block is rested, the base having opposite sides in the relative moving direction; a pair of support members of metal disposed on the opposite sides of the base and each having an inside surface facing the magnet block on the base and provided with a groove having a volume; and clamp members of rubber received in the grooves in the support members such that the clamp member partially protrudes from the groove toward the magnet block and abuts on the bottom of the groove; wherein the magnet block is clamped between the clamp member received in the groove in one support member and the clamp member received in the groove in the other support member, and the volume of the groove is equal to or larger than the volume of the clamp member received therein.

In another aspect, the invention provides a jig for fixedly holding the rare earth magnet in place during the cutting or grinding operation, comprising a base; a pair of support members of metal disposed on the base at spaced apart positions in the relative moving direction of the tool, each support member including an engagement ridge at its upper side, the magnet block being disposed between the engagement ridges of the spaced apart support members, the engagement ridge having an inside surface facing the magnet block and provided with a groove having a volume; and clamp members of rubber received in the grooves in the support members such that the clamp member partially protrudes from the groove toward the magnet block and abuts on the bottom of the groove; wherein the magnet block is fixedly clamped between the clamp member received in the groove in one support member and the clamp member received in the groove in the other support member, and the volume of the groove is equal to or larger than the volume of the clamp member received therein.

The jig configured in either of the above embodiments is effective for tightly holding the magnet block and preventing the magnet block from moving sideways during and immediately after machining operation.

In a preferred embodiment, the clamp member of rubber has a circular cross-sectional shape with a diameter D, and the groove in the support member for receiving the clamp member has a trapezoidal cross-sectional shape diverging toward the groove bottom, more preferably a trapezoidal cross-sectional shape having one or both bottom corners rounded. The groove defines in the inside surface of the support member an opening having a size of 0.8×D to 0.95×D and has a distance (or depth) of 0.75×D to 0.85×D between the opening and the bottom of the groove and an angle of 60 to 70 degrees included between the bottom side and the oblique side of the trapezoidal shape. In another preferred embodiment, the clamp member protrudes a distance of 0.1 to 4 mm from the groove toward the magnet block, and the protrusion distance is at least 2 times a dimensional variation of the magnet block to be cut. In a further preferred embodiment, the magnet block is held by clamping between the clamp member received in the groove in one support member and the clamp member received in the groove in the other support member and by abutment with both the support members. This ensures that the magnet is fixedly held.

In the case of the jig for use with the magnet cutting tool for cutting a magnet block into pieces, preferably the base and the support members are provided with a plurality of guide slits extending from their upper surface toward their lower surface so that the plurality of outer blades of the magnet cutting tool may be inserted into the guide slits during the cutting operation.

In a further aspect, the invention provides a jig arrangement wherein a plurality of jigs as defined above are juxtaposed in the relative moving direction of the cutting or grinding tool. Preferably, one jig and another jig are juxtaposed while sharing a support member therebetween. The common support member between juxtaposed jigs has opposite surfaces in the relative moving direction, and each of the opposite surfaces is provided with a groove for receiving the clamp member.

Advantageous Effects of Invention

When a rare earth magnet block is cut, ground or otherwise machined by a rotary abrasive tool, the jig holds the magnet block in place without a need for wax bonding. Despite simple construction, the jig prevents the workpiece from moving sideways during the machining operation and ensures machining operation at a high accuracy and high speed. The jig is of great worth in the industry.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein.

DESCRIPTION OF EMBODIMENTS

In the following description, the singular forms "a," "an" and "the" include plural referents unless the context clearly dictates otherwise. As used herein, terms such as "upper", "lower", "inside", "outside", and the like are words of convenience, and are not to be construed as limiting terms. The term "axial" is used with respect to the center of a circular blade (or the axis of a shaft) and a direction parallel thereto.

A rare earth magnet block is cut, ground or otherwise machined by a rotary cutting or grinding tool. The magnet cutting tool comprises a plurality of annular cores mounted on a rotating shaft at axially spaced apart positions and each having an outer blade on an outer periphery thereof. The magnet grinding tool comprises an annular or cylindrical core mounted on a rotating shaft and having an abrasive section on an outer periphery thereof.

The rotary tool and a rare earth magnet block are set in place. While the rotary tool is rotated, the rotary tool and the magnet block are relatively moved with the outer blade or abrasive section of the tool being kept in contact with the magnet block. Relative motion means that either one or both of the tool and magnet block are moved in a predetermined direction. Then the magnet block is cut or ground in the relative moving direction.

When the magnet block is machined by the rotary tool, the magnet block must be fixedly held. The invention provides a jig for fixedly holding the magnet block during the machining operation.

Figure 1:
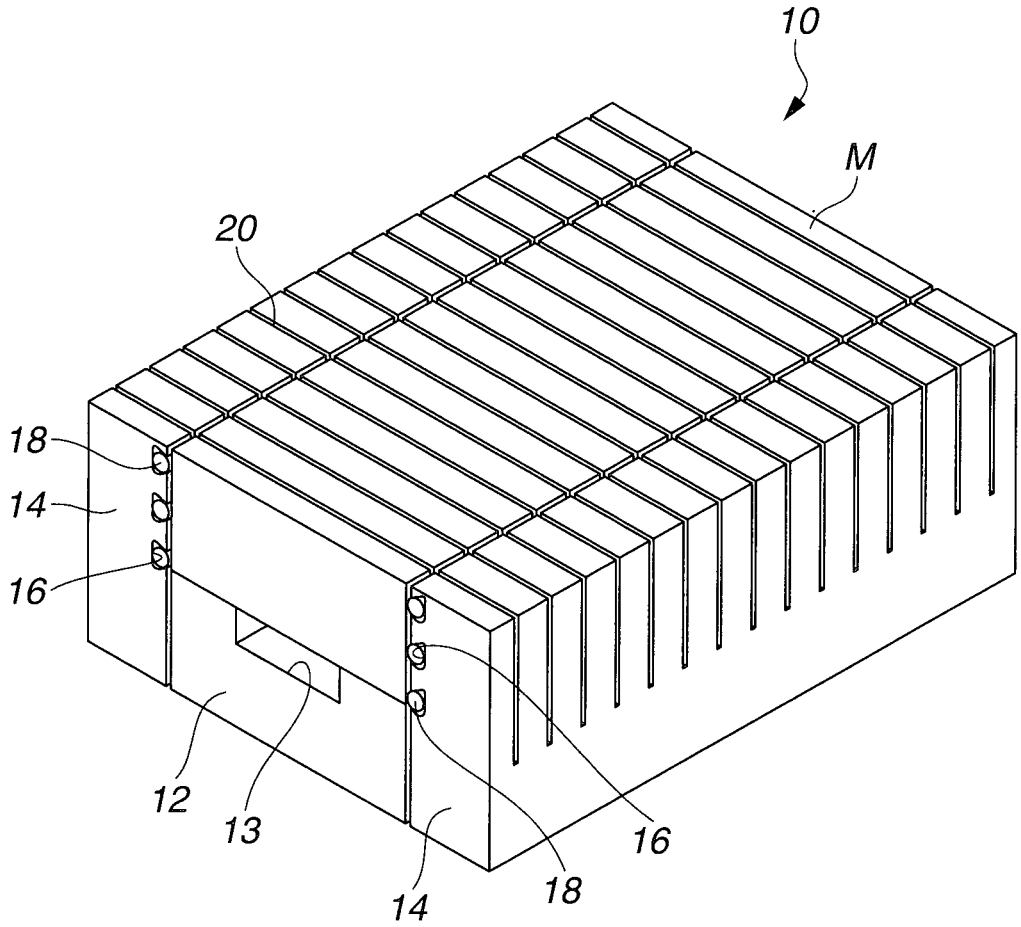
FIG. 1 is a perspective view of a magnet holding jig in one embodiment of the invention.
Figure 2:
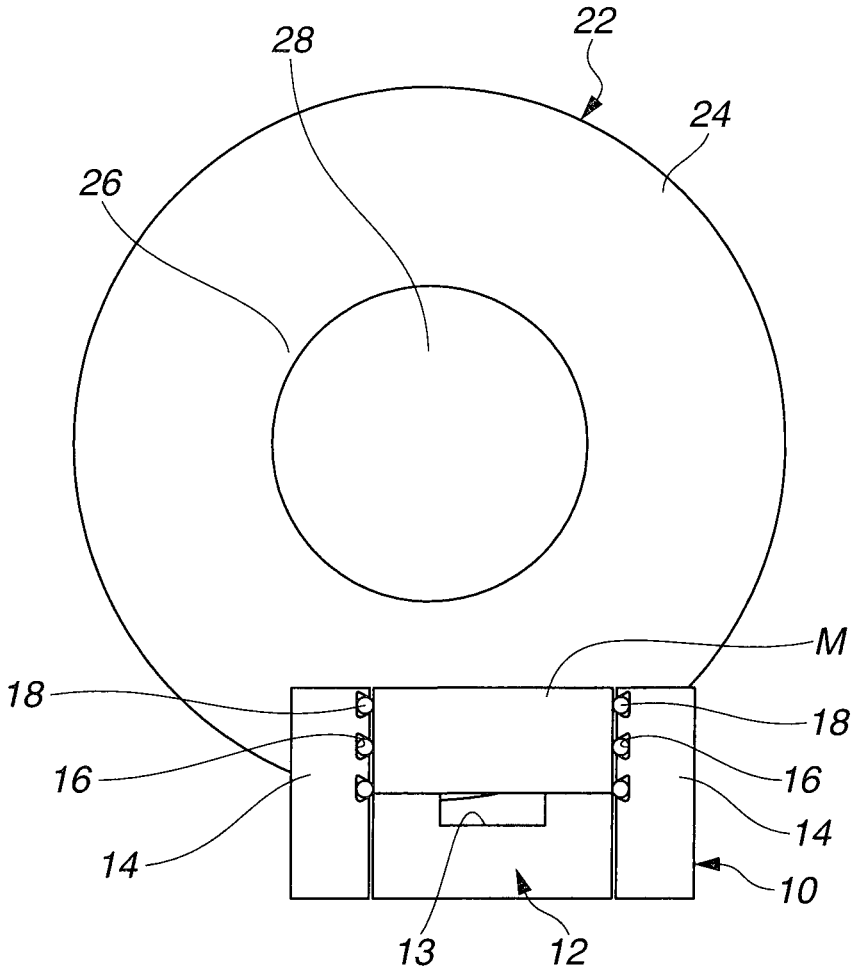
FIG. 2 is a side view of the jig in service during cutting operation of a magnet block by a cutting tool.

FIGS. 1 and 2 illustrate a magnet holding jig 10 in one embodiment of the invention. The jig 10 of this embodiment is used particularly when a magnet block is cut into pieces. The jig 10 includes a base 12 on which a magnet block M is rested, the base having opposite sides in the relative moving direction. The jig 10 further includes a pair of support members 14, 14 disposed on the opposite sides of the base 12 and having inside surfaces facing the magnet block M on the base 12 and provided with grooves 16, and clamp members 18 received in the grooves 16 in the support members 14.

The base 12 formed of a metal material such as steel, stainless steel, aluminum or brass has opposite sides in the relative moving direction, and is provided with a recess 13 at the center of its upper surface. The support members 14 formed of a metal material such as steel, stainless steel, aluminum or brass are disposed on the opposite sides of the base 12. The grooves 16 are formed in the opposed or inside surfaces of the support members 14. Although three grooves 16 are formed in each inside surface of the support member 14 in the embodiment of FIGS. 1 and 2, the number of grooves 16 is not particularly limited. Specifically one to ten grooves, more specifically one to five grooves may be formed in each surface.

The clamp members 18 are made of rubber which may be either natural rubber or synthetic rubber. Suitable synthetic rubbers include acrylic rubber, nitrile rubber, isoprene rubber, urethane rubber, butylene propylene rubber, silicone rubber, polyisobutylene rubber, styrene-butadiene rubber, chloroprene rubber, and butyl rubber. With respect to physical properties, the rubber preferably has a hardness Hs of 10 to 80, more preferably 40 to 70, because a magnet block can be tightly clamped and engaged by such rubber rods. Clamp members of different rubbers or different hardness may be fitted in plural grooves.

Figure 3:
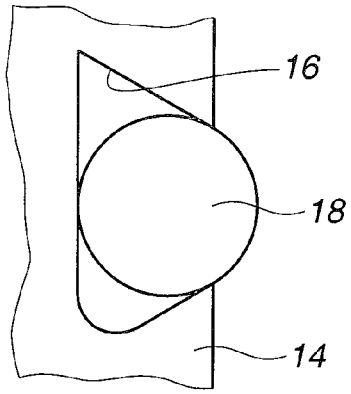
FIG. 3 illustrates a clamp member received in a groove of one exemplary magnet holding jig.
Figure 4:
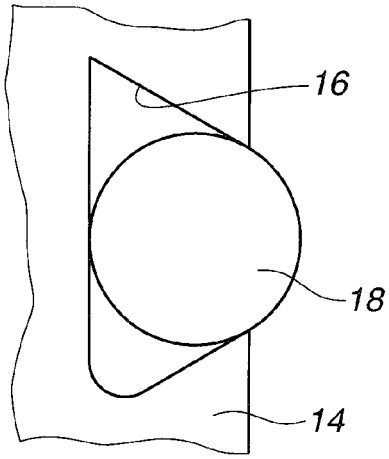
FIG. 4 illustrates a clamp member received in a groove of another exemplary magnet holding jig.
Figure 5:
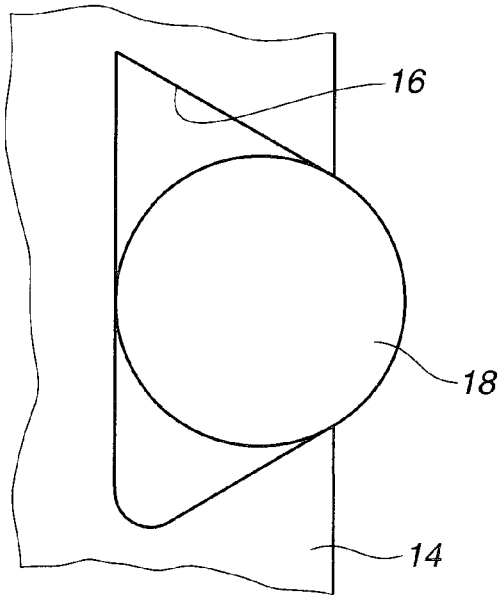
FIG. 5 illustrates a clamp member received in a groove of a further exemplary magnet holding jig.

The clamp member 18 is fitted in the groove 16 such that the clamp member 18 partially protrudes from the groove 16 toward the magnet block M and abuts on the bottom of the groove 16. As shown in FIGS. 3 to 5, the clamp member 18 preferably has a circular shape with a diameter D in cross section. The groove 16 defines an opening in the inside surface of the support member 14 and has a distance or depth between the opening and the bottom of the groove which is smaller than the diameter D of the clamp member 18. The volume of the groove 16 is equal to or larger than the volume of the clamp member 18. Also preferably the groove 16 has a trapezoidal cross-sectional shape diverging toward the groove bottom, preferably a trapezoidal cross-sectional shape having one or both bottom corners rounded, as best shown in FIGS. 3 to 5.

The magnet block M is clamped between the clamp members 18. The clamp member 18 is reacted by the magnet block M so that the protruding portion of the clamp member 18 is forced or depressed into the groove 16 while the clamp member 18 is deformed so as to expand toward the bottom corners of the groove 16. At this point, the magnet block M is held by clamping between the clamp members 18 received in the grooves 16 in the support members 14 and by direct abutment with the support members 14. In this way the magnet block is fixedly held in place.

Rubber is characterized in that deformation occurs with its volume substantially unchanged. Now that clamp member 18 of rubber is fitted in groove 16 having a cross-sectional area equal to or greater than the cross-sectional area of clamp member 18, clamp member 18 may be deformed, while keeping contact with the magnet block, until the magnet block comes in contact with the inside surface of support member 14.

Making experiments and studies, the inventors have found that a magnet block can be tightly held during machining by a combination of friction due to contact with rubber clamp members 18, deformation of rubber to accommodate dimensional variations of the magnet block, and rigid securement by metal support members 14.

If a magnet block is displaced during machining, deviations of machining dimensions occur and in addition, unnecessary forces act on the magnet block, causing chipping and other problems. To avoid these problems, the magnet block must be tightly held. While it is desired to tightly hold a magnet block by the metal support members 14, the metal support members 14 having a planar surface generally provide a hold by point contact because an actual magnet block has dimensional variations. It is then difficult to tightly hold a magnet block by the metal support members 14 because the point contact gives less friction and allows for rotation about the point. Additionally, a magnet block as cast generally has a dimensional variation of at least 1 mm after sintering, which means that the magnet block surface to come in contact with the support member 14 may have a roughness (or irregularity) of at least 1 mm. It is difficult to hold a magnet block having such an irregular surface with only the metal support members 14 which are substantially non-deformable. Little friction is expectable from the contact between metal and magnet.

Then, an ordinary approach is to attach rubber to the surface of metal support members so that a magnet block may be held while accommodating dimensional variations and surface roughness. However, since the elasticity of rubber is maintained after holding, the rubber will be deformed by any forces applied to the magnet block during machining, allowing the magnet block to be displaced.

It would be desirable to have a jig comprising metal support members and rubber components wherein a magnet block is tightly held by contact with the metal support members and the rubber components which are deformable to accommodate dimensional variations, and the contact of the magnet block with rubber is maintained even when the rubber is deformed, so that friction due to rubber is expectable.

The inventors have found that a magnet holding jig of the following construction is effective. The metal support member 14 is provided with a groove 16. A clamp member 18 in the form of a rubber rod is fitted in the groove 16. The depth of the groove 16 is less than the rubber clamp member 18 so that the rubber clamp member protrudes out of the groove 16. The cross-sectional area of the groove 16 is larger than the cross-sectional area of the rubber clamp member 18 so that the amount of deformation of the rubber clamp member 18 is accommodated. In setting up, the rubber clamp members 18 are brought in contact with a workpiece. As the rubber clamp members 18 are deformed, the metal support members come in contact with the workpiece to hold the workpiece. Since the workpiece is kept in contact with the rubber clamp members 18 even in this state, the holding of the workpiece is tightened by friction.

The material of which the jig is constructed desirably has a strength to withstand any spinning force of the magnet block in order to restrain any displacement of the magnet block in the holding position. For this reason, a metal material such as steel, stainless steel, aluminum or brass is used as mentioned above.

When the clamp member 18 is fitted in the groove 16, the clamp member 18 partially protrudes out of the groove 16. The distance of protrusion is preferably equal to or more than the dimensional variation of the magnet block. In a preferred embodiment, the clamp member 18 is in the form of a rubber rod of circular cross section having a diameter D, and the groove 16 is generally trapezoidal in cross section as shown in FIGS. 3 to 5. The groove 16 defines an opening in the inside surface of the support member, the opening having a size of 0.8×D to 0.95×D and has a depth of 0.75×D to 0.85×D between the opening and the bottom of the groove and an angle of 60 to 70 degrees included between the bottom side and the oblique side of the trapezoidal shape. The diameter D of the clamp member 18 may be suitably determined in accordance with the protrusion distance required by the dimensional variation of the magnet block and is typically in a range of 1 to 30 mm. The protrusion distance is typically in a range of 0.1 to 4 mm, and desirably at least 2 times the dimensional variation of the magnet block to be clamped. If a dimensional variation is 1 mm, then the protrusion distance is at least 2 mm, and the diameter D is 10 mm. If a dimensional variation is 0.5 mm, then the distance of protrusion is at least 1 mm, and the diameter is 5 mm. Depending on the shape of the magnet block to be clamped, a plurality of rubber clamps having different diameters may be combined with a plurality of grooves of different shapes.

In this way, the rubber clamp member 18 protrudes beyond the inside surface of the support member 14. The cross-sectional area of the groove 16 is larger than the cross-sectional area of the rubber clamp member 18, the rubber clamp member 18 is deformed and forced into the groove 16 so that the magnet block may come in contact with the surface of the metal support member 14 while the magnet block is kept in contact with the rubber clamp member 18. The trapezoidal shape of the groove prevents the rod-shaped rubber clamp member 18 from being disengaged from the groove 16. On the other hand, when the rubber clamp member 18 is mounted, it can be laterally inserted into the groove, or it can be inserted through the narrow opening since it is deformable.

FIG. 3 illustrates an example wherein a clamp member 18 having a diameter of 2 mm is fitted in a groove 16 so that the clamp member protrudes a distance of 0.42 mm from the support member surface. FIG. 4 illustrates another exemplary clamp member 18 having a diameter of 3 mm and a protrusion distance of 0.63 mm. FIG. 5 illustrates a further exemplary clamp member 18 having a diameter of 4 mm and a protrusion distance of 0.84 mm.

Since the cross-sectional area of groove 16 is larger than the cross-sectional area of clamp member 18, the protruding portion of clamp member 18 which contacts the magnet block and receives a clamping pressure upon holding is deformed until the magnet block contacts the support member 14. In this way, the magnet block is fixedly held.

The magnet holding jig of FIGS. 1 and 2 is suited for use when a rare earth magnet block is cut into pieces. In this embodiment, the base 12 and the support members 14, 14 are provided with a plurality of guide slits 20 extending from their upper surface toward their lower surface (in a comb-shaped fashion) so that the plurality of outer blades of the magnet cutting tool may be inserted into the guide slits 20 during the cutting operation.

Figure 6:
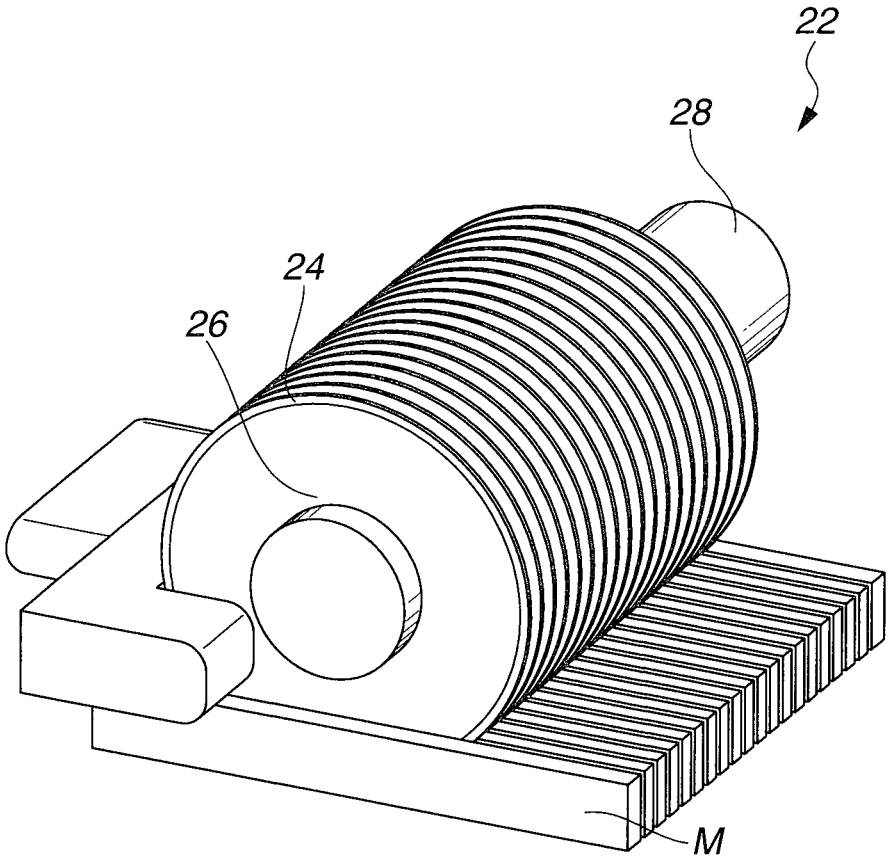
FIG. 6 is a perspective view illustrating one exemplary magnet cutting tool.

A magnet cutting tool 22 for use in cutoff machining of a rare earth magnet block is shown in FIGS. 2 and 6 as comprising a plurality of annular cores 26 mounted on a rotating shaft 28 at axially spaced apart positions and each having an abrasive outer blade 24 on an outer periphery thereof. While the outer blades 24 on the annular cores 26 are rotated together with the rotating shaft 28, the blades are relatively moved through the guide slits 20 in a moving direction from one support member 14 to the other support member 14. Then the magnet block is cut into pieces at a spacing corresponding to the spacing between the blades.

Once the magnet block to be cut is secured by holding by the jig, the rotary cutting tool is moved relative to the magnet block (i.e., the tool and/or the magnet block is moved) while feeding a cutting fluid to the tool, rotating the tool, and bringing the abrasive section or blades of the tool in contact with the magnet block. The magnet block is cut into pieces by the outer blades of the tool.

In the prior art, when a rare earth magnet block is cutoff machined by a multi-blade cutoff assembly, the magnet block is generally secured to a carbon-based support by bonding with wax or a similar adhesive which can be removed after cutting. In contrast, the magnet block is clamped and secured by the jig of the invention, the invention eliminates the bonding, stripping and cleaning steps of the prior art process, achieving a saving of the machining process.

Now that a workpiece is held by the jig of the invention during cutting operation, the workpiece is restrained from rotation in a longitudinal or transverse direction during machining operation. Since any displacement of the workpiece from the jig is prohibited, cutoff machining at a high accuracy is possible.

The components of the jig are constructed as shown in the figures such that the magnet block is mounted and dismounted by moving one or both of the support members toward and away from the magnet block linearly and parallel to the moving direction during the machining operation. The linear moving mechanism permits the jig to clamp magnet blocks of different size in the moving (or cutting) direction. If a magnet block has an increased length in the moving (or cutting) direction, then the base on which the magnet block is rested is replaced by a longer one, or a plurality of bases are combined to cover the length of the magnet block.

For holding a magnet block, either one or both of the support members are pushed against the magnet block from their outside surfaces and parallel to the moving (or cutting) direction. To keep the pressed state, the support members may be detachably secured to the base by pusher means such as screws (not shown). Instead of the screws for generating pushing pressure to hold the magnet block, any suitable pusher means such as a pneumatic or hydraulic cylinder or cam clamp as will be described in FIG. 10 may be used to generate a linear force for pushing the support members to hold the magnet block in place. Further a hydraulic cylinder or ball screws may be utilized.

Figure 7:
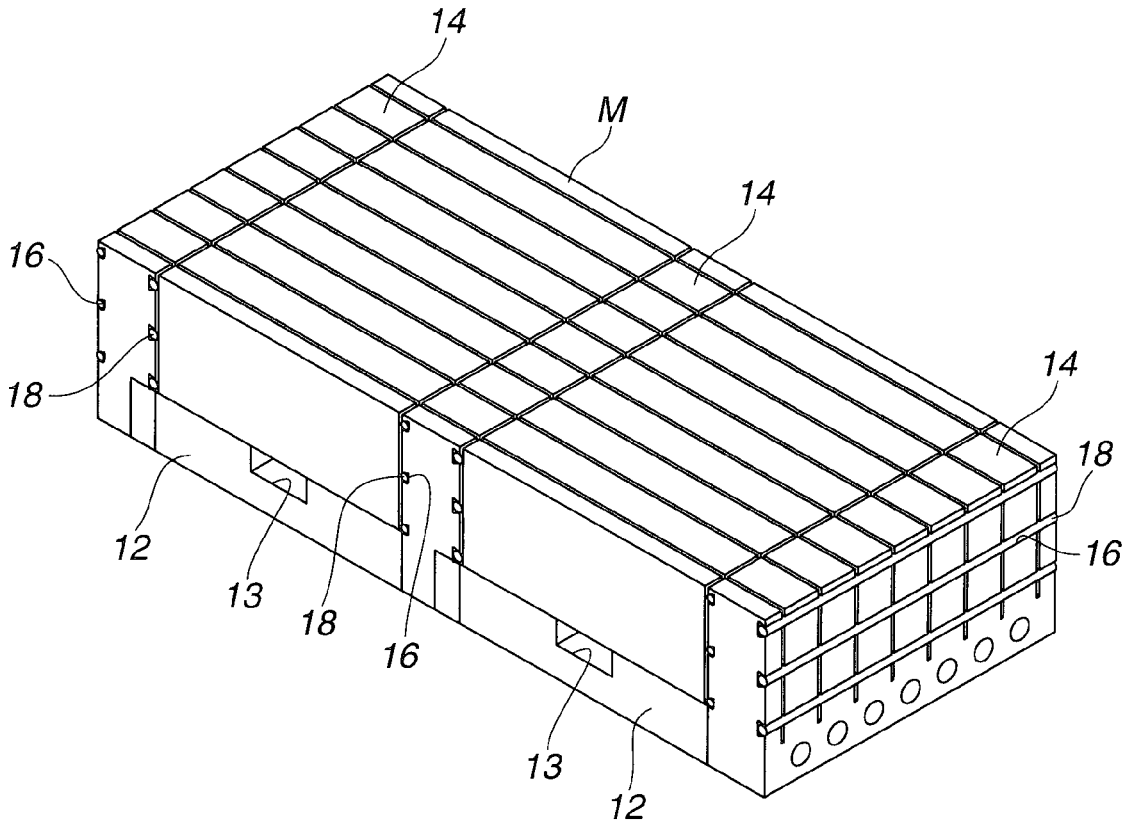
FIG. 7 is a perspective view of an arrangement having a plurality of jigs juxtaposed.

Another embodiment of the invention is a jig arrangement wherein a plurality of jigs as defined herein are juxtaposed in the relative moving direction of the cutting or grinding tool. FIG. 7 illustrates an exemplary jig arrangement including two juxtaposed jigs. One jig and another jig are juxtaposed while sharing an intermediate support member 14 therebetween. The intermediate support member 14 has opposite surfaces in the relative moving direction (facing magnet blocks), and each of the opposite surfaces is provided with grooves 16 for receiving clamp members 18. While two jigs are juxtaposed in the embodiment of FIG. 7, the support members 14 at opposite ends are provided with grooves 16 in which clamp members will be fitted, so that any additional jigs may be juxtaposed in tandem. In the jig arrangement, each support member may be provided on its opposite surfaces in the relative moving direction of the cutting or grinding tool with grooves for receiving clamp members.

Figure 8:
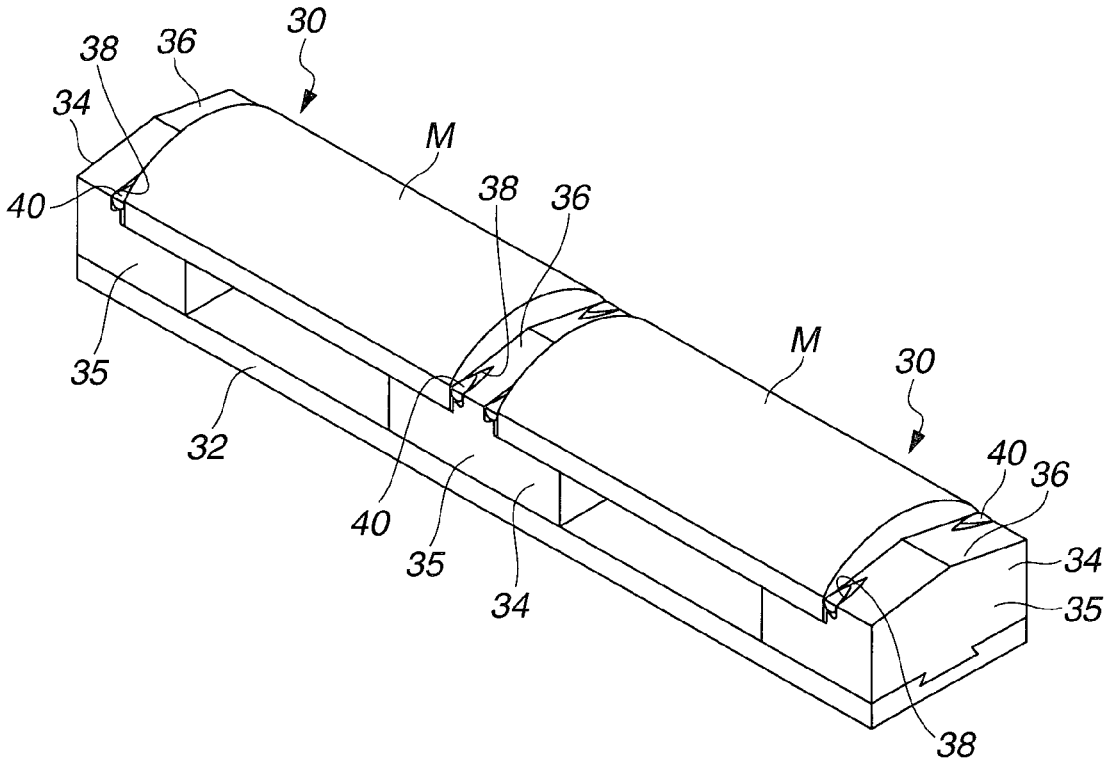
FIG. 8 is a perspective view of a magnet holding jig in another embodiment of the invention.

FIG. 8 illustrates another embodiment which is a jig for holding a rare earth magnet block, especially a semi-cylindrical top magnet block. In the illustrated embodiment, two jigs 30 are juxtaposed in the relative moving direction of the cutting or grinding tool. The jig comprises an elongated base 32. Three support members 34 of metal are removably disposed on the base 32 at spaced apart positions in the moving direction of the grinding tool. Each of the support members 34 at opposite ends includes a main body 35 in the form of a short quadrangular prism and an engagement ridge 36 of flat triangular shape in cross section integrally formed on the upper side of the main body 35 at its outer end. The center support member 34 includes a main body 35 in the form of a short quadrangular prism and an engagement ridge 36 of flat triangular shape in cross section integrally formed on the upper side of the main body 35 at its center. The semi-cylindrical magnet block M is disposed between and engaged with the engagement ridges 36 of the adjacent support members 34. An inside surface of the engagement ridge 36 facing the magnet block is provided with a groove 38 in which a rubber clamp member 40 is fitted in the same manner as in the embodiment of FIGS. 1 and 2.

Figure 9:
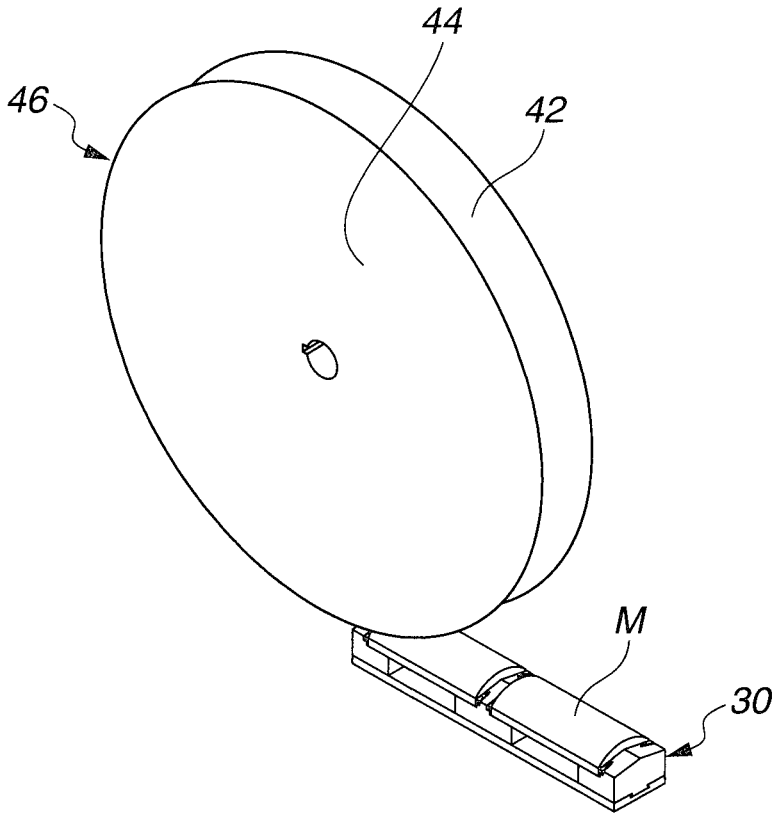
FIG. 9 is a perspective view illustrating the jig of FIG. 8 in service when a magnet block is ground.

The jig 30 is suited for use when a semi-cylindrical magnet block M is ground on its upper surface by a grinding tool 46 as shown in FIG. 9. The magnet grinding tool 46 is illustrated as comprising a cylindrical core 44 mounted on a rotating shaft (not shown). An abrasive section 42 having a concave circumference is formed on an outer periphery of the core 44. While the grinding tool 46 is rotated, it is moved relative to the magnet block M. The concave abrasive section 42 is contacted with the semi-cylindrical surface of the magnet block M for grinding.

If machining of a magnet block is cutoff machining using a multi-blade assembly comprising a plurality of outer-diameter blades and a corresponding plurality of spacers therebetween, the jig with rubber clamp members 18 mounted therein may be previously cut by the multi-blade assembly to define slits. Then the jig having slits for passage of blades is obtained. Also in the case of machining by a profile grinding tool, the jig with rubber clamp members 18 mounted therein is ground by the tool whereupon the jig is completed. In such manufacture process, a magnet block or a dammy block of carbon or the like having the same shape as the magnet block is clamped by the jig, and then the jig can be worked without the risk of rubber clamp members 18 being disengaged.

In the embodiments illustrated above, the groove in the support member extends parallel to the longitudinal direction of the support member (or the axial direction of the rotating shaft of the cutting or grinding tool) and accordingly, the rubber clamp member of cylinder or round rod shape extends in the same direction. The invention is not limited to these embodiments. For example, the support member may be provided with a groove which extends in a height direction of the support member (or perpendicular to the axial direction of the rotating shaft of the cutting or grinding tool) and in which a rubber clamp member is fitted. Note that for ease of description, the former and latter grooves may be referred to as horizontal and vertical grooves, respectively. In the embodiment of FIGS. 1 and 7 wherein the support members are provided with guide slits for passage of outer blades of the cutting tool, preferably the support member is provided at a position between the guide slits with a vertical groove for receiving a clamp member.

Figure 10:
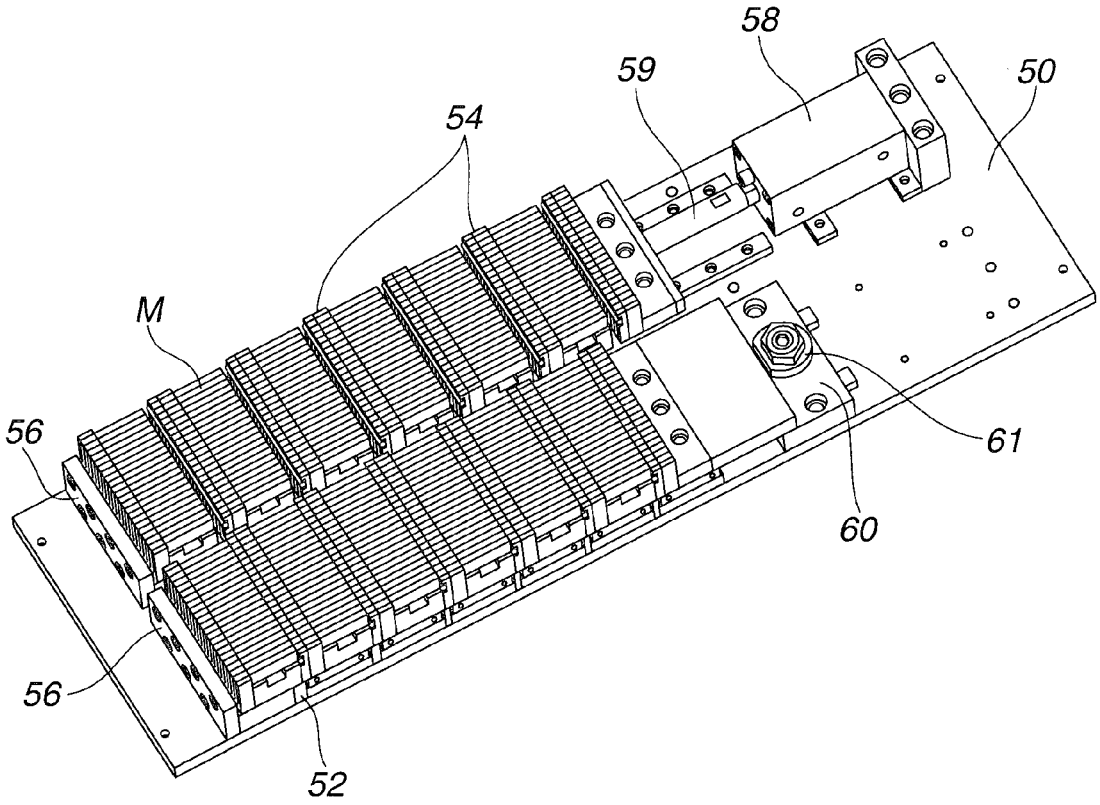
FIG. 10 is a perspective view of an arrangement of juxtaposed jigs, combined with a pusher mechanism.

FIG. 10 illustrates a mechanism for applying a pushing pressure to the holding jig, more particularly for applying a pushing pressure to a plurality of jigs at the same time. In FIG. 10, a plurality of jigs 54 are mounted on a platform 50 via mounts 52 and juxtaposed in the moving direction of the cutting tool. A stop wall 56 is disposed on one side of the jig arrangement in the moving direction so that the jig arrangement is engaged with the stop wall 56. Disposed on the other side of the jig arrangement is a pneumatic cylinder 58 or cam clamp 60 which functions to push the jig arrangement toward the stop wall 56 via a piston 59 or cam 61. Since members are configured to clamp a magnet block therebetween to hold it in place by relying on linear movement parallel to the moving direction, only a single pusher source may be used to hold a plurality of magnet blocks in place at the same time.

Of course, the pushing mechanism may be applied to a single jig. Also, the jig may be positioned on the platform for motion in the moving direction and removably secured to the platform, using screws as described above.

The workpiece which is intended herein to be cut, ground or otherwise machined is a rare earth magnet block, typically a sintered one. Although the rare earth magnet as the workpiece is not particularly limited, suitable rare earth magnets include sintered rare earth magnets of R—Fe—B systems wherein R is at least one rare earth element inclusive of yttrium.

Suitable sintered rare earth magnets of R—Fe—B system are those magnets containing, in weight percent, 5 to 40% of R, 50 to 90% of Fe, and 0.2 to 8% of B, and optionally one or more additive elements selected from C, Al, Si, Ti, V, Cr, Mn, Co, Ni, Cu, Zn, Ga, Zr, Nb, Mo, Ag, Sn, Hf, Ta, and W, for the purpose of improving magnetic properties and corrosion resistance. The amounts of additive elements added are conventional, for example, up to 30 wt % of Co, and up to 8 wt % of the other elements. The additive elements, if added in extra amounts, rather adversely affect magnetic properties.

Suitable sintered rare earth magnets of R—Fe—B system may be prepared, for example, by weighing source metal materials, melting, casting into an alloy ingot, finely dividing the alloy into particles with an average particle size of 1 to 20 μm, i.e., sintered R—Fe—B magnet powder, pressing the powder in a magnetic field, sintering the compact at 1,000 to 1,200° C. for 0.5 to 5 hours, and heat treating at 400 to 1,000° C.

EXAMPLE

Examples and Comparative Examples are given below for further illustrating the invention although the invention is not limited thereto.

Example 1

OD blades (cutoff abrasive blades) were fabricated by providing a doughnut-shaped disk core of cemented carbide (composed of WC 90 wt %/Co 10 wt %) having an outer diameter 150 mm, inner diameter 60 mm, and thickness 0.5 mm, and bonding, by the resin bonding technique, diamond abrasive grains to an outer peripheral rim of the core to form an abrasive section (outer blade) containing 25% by volume of diamond grains with an average particle size of 150 μm. A multiple blade assembly was manufactured by mounting OD blades on a rotating shaft.

Using the multiple blade assembly, a cutting test was carried out on a workpiece which was a sintered Nd—Fe—B magnet block. The test conditions are as follows. The workpiece was a sintered Nd—Fe—B magnet block having a length 100 mm, width 30 mm and height 17 mm, which was polished at an accuracy of ±0.05 mm by a vertical double-disk polishing tool.

A jig as shown in FIGS. 1 and 2 was used to hold the magnet block in place. The jig included support members for clamping the magnet block in the cutting direction, which were made of aluminum and had a length of 15 mm in the cutting direction. The jig also included clamp members in the form of a rubber rod, which were inserted into grooves in the magnet-facing surfaces of the support members. The rubber rod was made of nitrile rubber having a hardness Hs of 66 and had a circular cross section with a diameter of 3 mm. The groove had a trapezoidal cross section as shown in FIG. 4, defined an opening having a size of 2.49 mm, and had a depth of 2.37 mm between the opening and the bottom and an angle of 66° included between the bottom and oblique sides of the trapezoidal groove. The clamp member or rubber rod protruded a distance of 0.63 mm from the support member surface.

For cutoff machining operation, a cutting fluid was fed at a flow rate of 30 L/min. First, the multiple blade assembly was positioned above one support member side and descended toward the magnet block. While feeding the cutting fluid from the feed nozzle and rotating the cutoff abrasive blades at 5,000 rpm, the multiple blade assembly was moved at a speed of 150 mm/min toward the other support member side for cutoff machining the magnet block into pieces. Each of the magnet pieces was measured for thickness at 5 points (i.e., center and four corners of rectangular cut section). A difference between the maximum and minimum thicknesses was computed and reported as a size variation.

Comparative Example 1

A cutting test was carried out on a workpiece under the same conditions as in Example 1 except that the workpiece was bonded to a carbon plate using wax.

Comparative Example 2

A cutting test was carried out on a workpiece under the same conditions as in Example 1 except that the clamp members were omitted, that is, the workpiece was held only by contact with the support members.

Comparative Example 3

A cutting test was carried out on a workpiece under the same conditions as in Example 1 except that rubber sheets of 1 mm thick were attached to the support members and the workpiece was held only by contact with the rubber sheets.

The results are shown in Table 1.

Example 1 demonstrated a minimal size variation. In Example 1, residual marks on some magnet pieces indicated displacement in the rotational direction of the OD blades. Nevertheless, no displacement occurred in a direction contacting the blade, and the magnet block was not disengaged from the rigid support members made of metal. Thus such displacement had no impact on dimensional accuracy.

Comparative Example 1 showed a comparable size variation, but needed wax bonding, stripping and cleaning steps. In Comparative Example 2, the magnet block was disengaged, and the cutting operation could not be continued to completion. In Comparative Example 3, the cutting operation was possible, but the size variation was noticeable because of elastic holding.

TABLE 1

| | Example 1 | Comparative Example 1 | Comparative Example 2 | Comparative Example 3 |
|---|---|---|---|---|
| Degree of profiling (mm) | 0.1 | 0.2 | 0.8 | 0.5 |
| Remarks | no problem | sometimes disengaged due to bond failure | not disengaged, but substantial displacement due to workpiece rotation | could be held, but displacement due to rubber deformation |

Japanese Patent Application No. 2011-141504 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A jig for fixedly holding the rare earth magnet block in place during a cutting or grinding operation, comprising;

a base on which the magnet block is to be rested, the base having opposite sides in a direction, a pair of support members of metal disposed on the opposite sides of the base and each of the support members having an inside surface provided with a groove, and clamp members of rubber received in the grooves in the support members such that the clamp member partially protrudes from the groove and abuts on the bottom of the groove, wherein the magnet block is to be clamped between the clamp member received in the groove in one support member and the clamp member received in the groove in the other support member, and of the groove has a volume equal to or larger than the volume of the clamp member received therein.

2. A jig for fixedly holding the rare earth magnet block in place during the cutting or grinding operation, comprising a base, a pair of support members of metal disposed on the base at spaced apart positions in the relative moving direction of the tool, each support member including an engagement ridge at its upper side, the magnet block being to be disposed between the engagement ridges of the spaced apart support members, the engagement ridge having an inside surface facing the magnet and provided with a groove, and clamp members of rubber received in the grooves in the support members such that the clamp member partially protrudes from the groove toward the magnet block and abuts on the bottom of the groove, wherein the magnet block is to be clamped between the clamp member received in the groove in one support member and the clamp member received in the groove in the other support member, and the groove has a volume equal to or larger than the volume of the clamp member received therein.

3. The jig of claim 1 wherein the rubber clamp member has a circular cross-sectional shape with a diameter D, the groove in the support member for receiving the clamp member has a trapezoidal cross-sectional shape diverging toward the groove bottom, the groove defines in the inside surface of the support member an opening having a size of 0.8×D to 0.95×D and has a distance of 0.75×D to 0.85×D between the opening and the bottom of the groove and an angle of 60 to 70 degrees included between the bottom side and the oblique side of the trapezoidal shape.

4. The jig of claim 3 wherein the trapezoidal cross-sectional shape has one or both bottom corners rounded.

5. The jig of claim 1 wherein the clamp member protrudes a distance of 0.1 to 4 mm from the groove toward the magnet block, and the protrusion distance is at least 2 times a dimensional variation of the magnet block to be cut.

6. The jig of claim 1 wherein the magnet block is held by clamping between the clamp members received in the grooves in the support members and abutment with the support members.

7. The jig of claim 1 wherein the base and the support members are provided with a plurality of guide slits extending from their upper surface toward their lower surface so that the plurality of outer blades of the magnet cutting tool may be inserted into the guide slits during the cutting operation.

8. A jig arrangement wherein a plurality of jigs as set forth in claim 1 are juxtaposed in the relative moving direction of the cutting or grinding tool.

9. The jig arrangement of claim 8 wherein one jig and another jig are juxtaposed while sharing a support member therebetween, and the support member between juxtaposed jigs has opposite surfaces in the relative moving direction, each of which is provided with a groove for receiving the clamp member.

* * * * *